United States Patent [19]

Genest et al.

[11] 4,125,008

[45] Nov. 14, 1978

[54] ELECTRICALLY OPERATED LOCK

[75] Inventors: Leonard J. Genest, Santa Ana; Daryle Messner, Buena Park, both of Calif.

[73] Assignee: Monitron Industries, Inc., Santa Ana, Calif.

[21] Appl. No.: 631,554

[22] Filed: Nov. 13, 1975

Related U.S. Application Data

[63] Continuation-in-part of Ser. No. 577,124, May 13, 1975, abandoned.

[51] Int. Cl.[2] ..... E05B 47/00

[52] U.S. Cl. ..... 70/279; 70/135; 70/277; 292/280

[58] Field of Search ..... 70/135, 277, 278, 279, 70/138; 292/280

[56] References Cited

U.S. PATENT DOCUMENTS

| | | | |
|---|---|---|---|
| 421,567 | 2/1890 | Grah | 70/279 |
| 848,256 | 3/1907 | Maaskant | 70/278 |
| 2,767,010 | 10/1956 | Norman | 292/280 |
| 2,793,898 | 5/1957 | Roethal | 292/280 |
| 2,870,620 | 1/1959 | Allison | 70/135 |
| 2,904,988 | 9/1959 | Gaida | 292/280 X |
| 2,948,561 | 8/1960 | Eatinger | 292/280 |
| 3,733,861 | 5/1973 | Lester | 70/153 |
| 3,926,021 | 12/1975 | Genest et al. | 70/278 |

FOREIGN PATENT DOCUMENTS

| | | | |
|---|---|---|---|
| 116,683 | 3/1943 | Australia | 292/280 |
| 618,330 | 4/1961 | Canada | 292/280 |

*Primary Examiner*—Rodney H. Bonck

[57] ABSTRACT

A unitary self-contained electrically operated lock is provided which includes a latch wheel manually releasably rotatable from a first side of the lock housing by pulling on a handle from a first side and releasably rotatable from a second side of the housing only in response to insertion of a data combination card carrying an appropriate code. The latch wheel is mounted outside the housing on a rotatable shaft extending into the housing. A ratchet wheel mounted inside the lock housing on the rotatable shaft rotates with the latch wheel. A pawl normally engaged with the ratchet wheel allows the latch wheel to rotate into locking engagement with a keeper mounted in a door jamb while preventing the latch wheel from rotating out of engagement with the keeper until the pawl is retracted. A trip plate secured to the handle disengages the pawl from the ratchet wheel whenever the handle is manually retracted. Upon insertion of a correctly coded data combination card, a solenoid or motor mounted within the housing is activated to retract the pawl from engagement with the ratchet wheel.

10 Claims, 21 Drawing Figures

FIG. 14
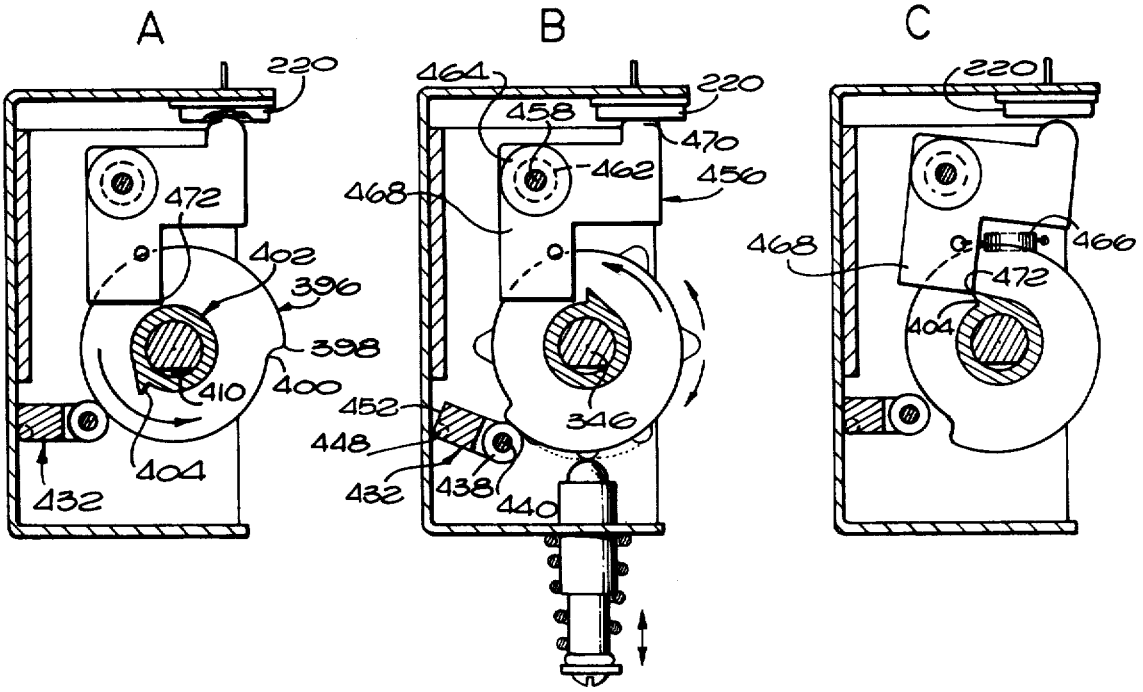
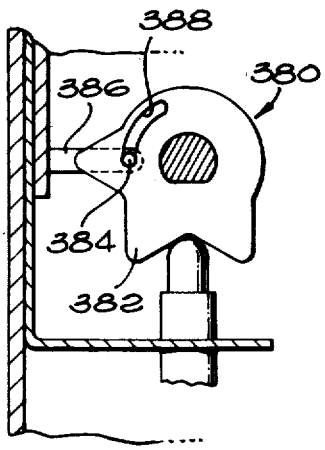
FIG. 13
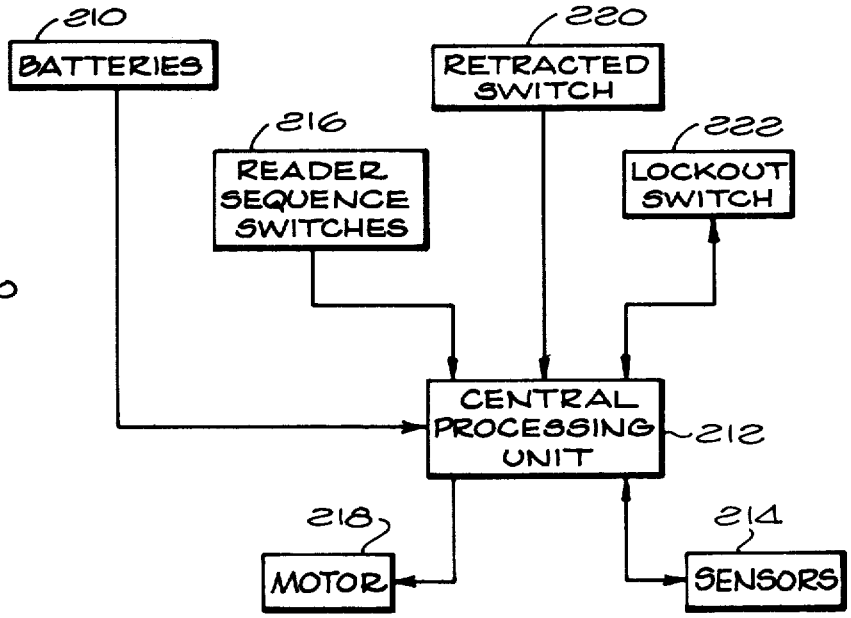
FIG. 8

ELECTRICALLY OPERATED LOCK

CROSS-REFERENCE TO RELATED APPLICATIONS

This application is a continuation-in-part of application Ser. No. 577,124, filed May 13, 1975, entitled "Electrically Operated Lock", and now abandoned.

BACKGROUND OF THE INVENTION

This invention relates to an electrically operated lock and, more particularly, to a lock having a rotary latch wheel operable from the inside by manual activation of handle and normally operable from the outside only by use of a correctly coded data combination card.

This invention has particular application to use in buildings, such as hotels, having a large number of rooms required to be locked, and is intended to replace the conventional mechanical lock and key system now in general use. However, it will be understood that the lock of this invention could be employed in any building or enclosure requiring a locked door, such as automobiles.

In typical electronic systems for controlling entrance to protected areas, a door is provided with an electronic lock which responds to a preselected combination code contained on a key which frequently takes the form of a card. If a person wishing to gain entrance through the door inserts the card into a receptacle associated with the lock, the lock circuitry actuates the bolt if the card is correctly coded. Such electrically operated locks have very significant advantages as compared with conventional lock systems, such as the very large number of code combinations which are available on a card of very small size.

However, the mechanical portion of such locks frequently necessitates complex circuitry and mechanical features in order to provide a lock which is mechanically operable from the inside as well as electrically operable from the outside and which takes into consideration the various states which the lock may assume under all conditions of its operation. For example, some locks require a plurality of switches to indicate to the electronics when certain cams or gears are in one position or another, whether the bolt is extended or retracted, and whether the electronics may proceed to the next step. Other such locks require complicated gearing to allow mechanical operation of the lock to override the electrical operation or to initiate the electrical operation.

The invention shown and described herein overcomes these defects by providing a simple mechanical mechanism which may be operated both electrically from outside the door by insertion of an appropriately coded data combination card and mechanically from inside the door by actuating a handle. The requirements for complicated cams or gearing, override mechanisms for motors, complex switch apparatus to indicate the state of the mechanics, and the like are eliminated. In addition, the lock of this invention is reliable, self-contained, has low power requirements, and is inexpensive to construct.

SUMMARY OF THE INVENTION

An independently operable electric lock is provided which is actuable in response to both insertion of an appropriate data combination code from a first side of the lock and movement of a handle from a second side of the lock. The lock housing is secured in the door with a rotatable latch wheel protruding from the housing adapted to engage a keeper in the door jamb. A rotatable ratchet wheel inside the housing is connected to rotate with the latch wheel. A retractable pawl is normally biased into engagement with the ratchet wheel to prevent the latch wheel from rotating out of engagement with the keeper when the door is closed. Means are provided for retracting the pawl from the ratchet wheel when the handle is operated. Means are provided within the housing for receiving and detecting an inserted combination code, comparing the inserted combination with combination information stored within the housing, and generating an activation signal when the comparison is favorable. Means are also provided within the housing to retract the pawl from the ratchet wheel in response to the activation signal. The energy source for the lock is contained within the housing.

BRIEF DESCRIPTION OF THE DRAWINGS

In the drawings which constitute a part of this specification, exemplary embodiments demonstrating various features of this invention are set forth wherein:

FIG. 8 is a schematic block diagram of the electrical system employed in the second embodiment of this invention;

FIG. 13 is an alternative construction of the ratchet wheel shown in FIG. 12;

FIGS. 14A, 14B, and 14C are cross-sectional elevational views taken along the line 14—14 of FIG. 9 and showing the operation of various cam elements of the second embodiment;

DESCRIPTION OF THE INVENTION

Figure 1:
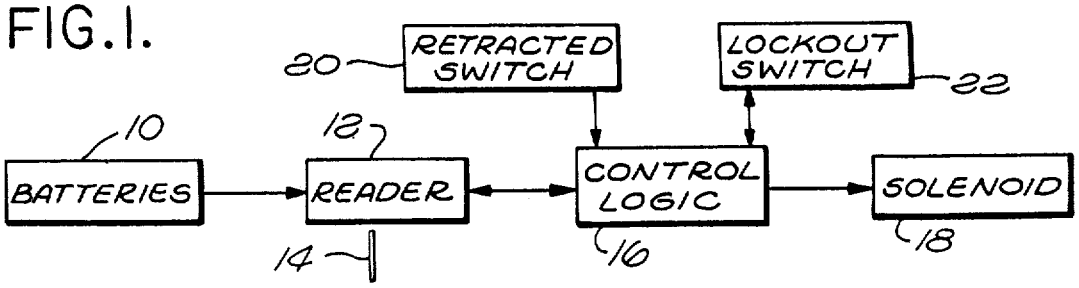
FIG. 1 is a schematic block diagram of the electrical system employed in the first embodiment of this invention.

This invention is shown and described herein with reference to an electrically operated lock for use with a data combination card, such as might be employed in the door of a hotel or the like. As will become apparent, however, the principles of this invention are applicable to various other types of locking mechanisms.

The first embodiment of the invention shown in FIGS. 1–7 includes a reciprocating handle 114 operable from inside the door by grasping the handle and pulling it horizontally inwardly. A horizontally disposed trip plate 134, secured to the handle and having a cam edge 140, engages one end of a pawl arm 104 to pivot a pawl 110 out of engagement with the ratchet wheel 84. A latch wheel 38, connected to the ratchet wheel by shaft 44, is then free to rotate and the door may be opened by continuing to pull on the handle 114.

In order to open the door from the outside, a coded combination card 14 is inserted into a card reader slot 34 to depress a rocker arm 146 into engagement with one end of the restraining spring 154. When the reader receives an authorized combination code, a solenoid 18 is activated to attract the lower end of the pawl arm and withdraw the pawl from engagement with the ratchet wheel 84. At the same time, the upper end of the pawl arm pivots into engagement with a lug 160 depending from the restraining spring 154 to restrain the pawl from engaging the ratchet wheel until the card is removed from the card reader. When the pawl arm pivots to bring magnet 166 adjacent switch 20, the magnetic switch 20 indicates that the pawl has been retracted and the solenoid is deactivated by control logic 16. With the pawl retracted, the latch wheel is free to rotate, as previously described, so that the door may be pushed open.

When the room occupant desires to deactivate the lock to prevent entry by hotel service personnel or the like, a lockout pin 170 may be pushed so that it protrudes from the outside of the lock housing. In this position, a lockout switch 22 is tripped by a pin flange 178 to disconnect batteries 10 from the solenoid 18. The solenoid is reconnected whenever the latch wheel is rotated, such as by opening or closing the door. As the latch wheel 38 is rotated, a detent wheel 62 is also rotated to push a cam end 196 of a detent spring 72 against a spring biased latch plate 180. As the latch plate rotates downwardly, the lockout pin 170 will spring inwardly releasing the microswitch 22 and reconnecting the batteries to the solenoid so that the lock may once again be operated from the outside by a correctly coded combination card.

More specifically, the electrical system for the lock of the first embodiment is shown schematically in FIG. 1 where batteries 10 provide a source of power for the electrical system. A reader 12, electrically connected with the batteries, receives the coded data combination card 14. The control logic 16 instructs the reader to scan the card and, when an authorized combination is detected, the control logic activates the solenoid 18 to actuate the mechanical portion of the lock. The retracted switch 20 is electrically connected to the control logic to enable the control logic to deactivate the solenoid when the pawl has been retracted from the ratchet by the solenoid, as will be explained hereinafter. In addition, the lockout switch 22 provides a signal to the control logic to connect or disconnect power to the solenoid so that certain types of data combination cards will not operate the door even if the cards are correctly coded, as will be explained hereinafter.

In this first embodiment of the invention, the card 14 has selected metallic areas which alter the output of the reader 12. It will be understood, however, that various other types of cards and readers may be employed as well as other power sources. In addition, an electromagnet or other form of motive power may be employed in place of the solenoid.

As is shown in FIGS. 2–5, the entire electrically operated lock of the first embodiment of this invention is contained in a housing 30 and installed in the door of a room or the like. The housing is preferably molded or cast of a sturdy material, such as aluminum, brass or engineering plastic, which will withstand weathering and also resist attempts to break through the lock from the outside. All necessary items for operation of this embodiment of the invention, except for the data combination card 14 carried by the room occupant, are contained within the housing 30, including the necessary battery power supply, thus rendering each unit fully independent and self-contained.

The housing has a protruding section 32 with slot 34 for receiving the data combination card 14 to be inserted from outside the door. A protruding section depending lip 36 provides convenient means for pushing or pulling on the door from the outside once the lock is opened. Thus, there is no mechanical linkage into the lock from outside the door and the door may be opened from the outside only by inserting a correctly coded data combination card into the lock, pausing momentarily while the necessary electronic functions are performed and the latch wheel is freed for rotation, and then pushing on the protrusion 32 to open the door.

The housing dimensions may be altered to fit practically any existing door and jamb system. Installation only requires cutting an appropriate size notch inwardly from the side or edge of the door, sliding the housing 30 into the notch, and securing the housing to the door by screws or the like. The entire system may be assembled or repaired at a remote location and tested before shipment so that installation is accomplished in a matter of minutes. Since each unit is independent and contains its own energy source, connection to a high energy source or to a central control system is not required.

The rotary bolt or latch wheel 38, shown in FIGS. 3–7 having six equally spaced engaging lugs 42 and bottom lands 40, is secured to the outer extending end of rotatable shaft 44 and extends beyond the edge of the door to engage a keeper 46. The latch wheel, shaft and keeper are composed of hardened steel or the like and the latch wheel is retained on the shaft 44 against the annular shaft shoulder 50 (FIG. 5) by means of welding, swaging or the like. The keeper 46 is secured to the door jamb by screws or the like and has one protruding lug 48 which extends into the keeper in a direction perpendicular to the line of travel of the door as its opens and closes. As one of the latch wheel lugs 42 engages the keeper lug 48 when the door is in the process of being closed, the latch wheel is forced to rotate until the keeper lug fits snugly between two adjacent latch wheel lugs.

The shaft 44 is mounted within the housing on support member 52 secured to the housing by screws, welding or the like (not shown). A plastic bearing ring or sleeve 54, surrounds the shaft and bears against the shaft shoulder 56. The bearing sleeve rides in a circular aperture 58 cut out of the member 52. A roll pin 60 extends through the shaft 44 and an annular shank 64 of the detent wheel 62 with the support member 52 pushed against the housing thereby preventing lateral movement of both the detent wheel and of the bearing sleeve 54 abutting the shank.

The detent wheel 62, composed of steel or the like, is similar to the latch wheel 38, having six lugs or teeth 66, each tooth providing two sides 68 and adjacent teeth providing a bottom land 70 between them. A detent spring, 72, composed of spring metal, is secured at its upper end to support member 74 by rivets, screws or the like 76, and carries roller 78, composed of nylon or the like, adjacent its lower end for engagement with the teeth sides 68 and bottom lands 70 of the detent wheel. The roller 78 is rotatably secured to the spring 72 by a roll pin 80 passing longitudinally loosely through the roller and secured at its ends to a U-shaped bracket 82 which is riveted to the spring 72.

Figure 6:
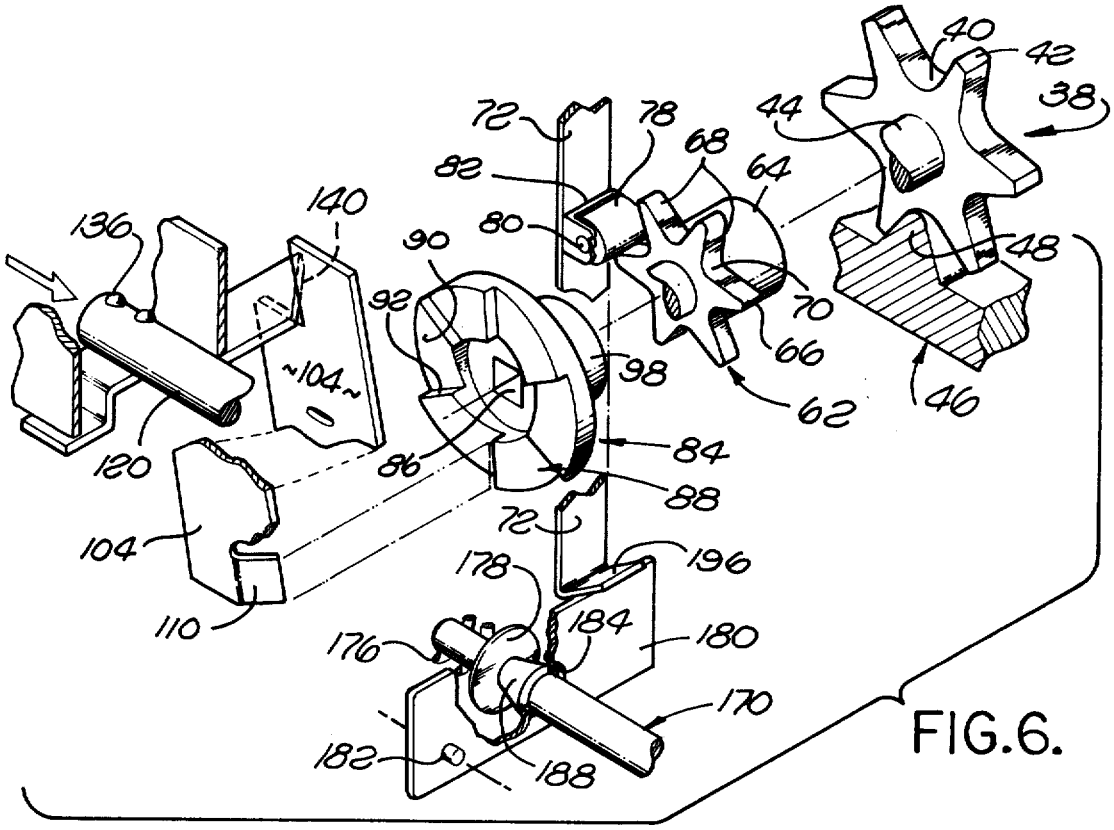
FIG. 6 is an exploded perspective view of certain elements of the first embodiment of this invention with the door closed.
Figure 7:
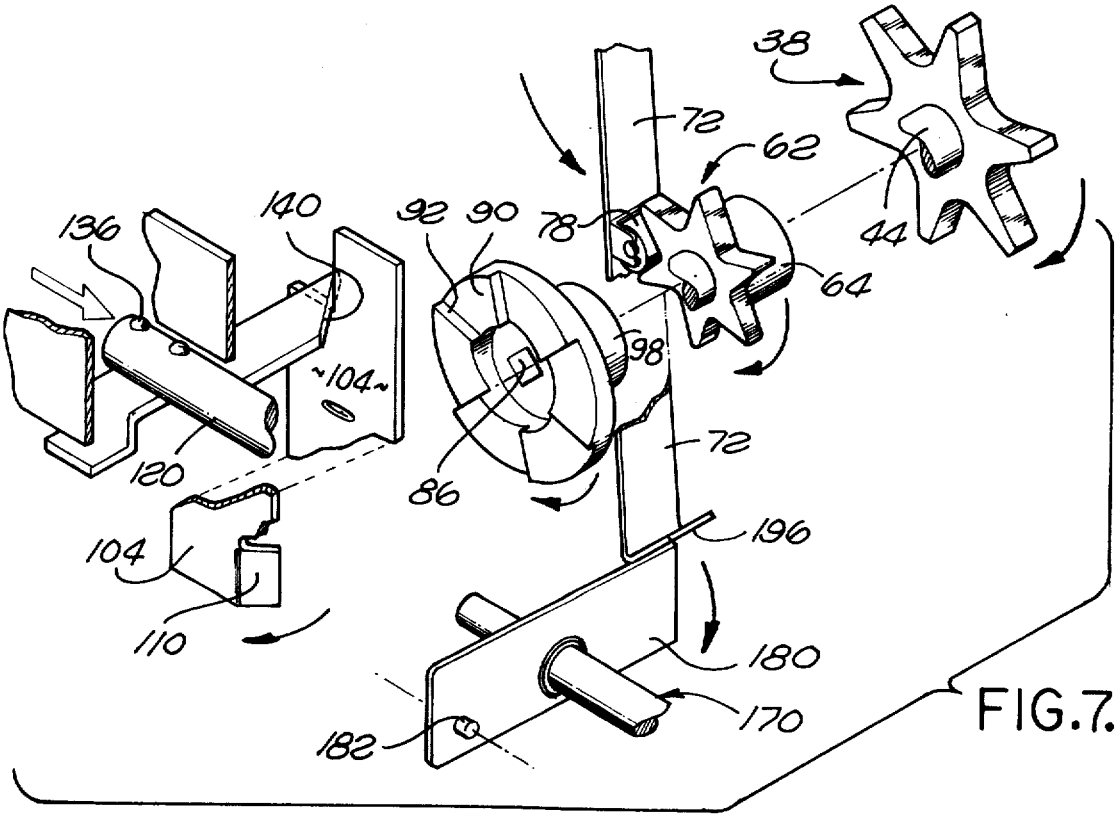
FIG. 7 is an exploded perspective view of certain elements of the first embodiment of this invention with the door open.

The teeth of the latch wheel and detent wheel are misaligned by about 10°-15° so that when the door is open, the roller 78 rests in a detent wheel bottom land 70 between two detent wheel teeth 66 and the lowermost latch wheel lug 42 is angled 10°-15° from the vertical towards the keeper lug 48 (see FIGS. 6 and 7.) This positions the latch wheel for correct engagement with the keeper lug 48. As the lowermost latch wheel lug comes into contact with the keeper lug, the latch wheel will rotate counterclockwise about 45°, as may be seen from a comparison of FIG. 7 with FIG. 6. At the same time, the detent wheel will also rotate 45° so that the roller 78 rides up off of the bottom land 70 (FIG. 7) and over a detent wheel tooth to rest on the opposite inclined side 68 of the adjacent detent tooth (FIG. 6). In this position, the detent spring and roller apply a biasing force to the detent wheel which attempts to continue the counterclockwise closing rotation of the detent wheel, shaft and latch wheel, thus holding the door firmly shut.

The shaft 44 has a rectangular cross-section at the end remote from the latch wheel and is received in a rectangular central bore 86 of the ratchet wheel 84. The ratchet wheel is otherwise unsecured to the shaft 44 so that the shaft may slide longitudinally within the bore, as will be explained hereinafter. The six ratchet wheel teeth 88 formed on the face of the ratchet wheel each have a ramp or cam surface 90 inclined at an acute angle to the face of the ratchet wheel and a catch face or surface 92 perpendicular to the face of the ratchet wheel. The ratchet wheel 84 is oriented on the shaft 44 so that the catch surfaces 92 are approximately aligned with the bottom lands 40 of the latch wheel 38. In this manner, an upper and a lower catch surface on the ratchet wheel will lie in approximately a vertical plane when the door is closed (FIG. 6).

The ratchet wheel is maintained in position by support member 94 which engages plastic bearing ring 96 surrounding a ratchet wheel shank 98. The bearing ring 96 is held against a ratchet wheel shoulder 100 by snap ring 102 which engages a circular groove cut in shank 98. The support arm 94 is secured to the housing by welding or the like (not shown) so that attempts to pull the latch wheel 38 and the shaft 44 outwardly, such as by a person breaking into a room or the like, will merely cause the shaft 44 to slide in the ratchet wheel central bore 86 without the ratchet wheel disengaging the pawl. This slip fit of the ratchet wheel 84 and the shaft 44 thus provides assurance that any attempted unauthorized entry by working against the protruding lock elements will not result in unlocking the internal mechanism.

The pawl arm 104, having a ferrous metal plate 106 secured at one end, is pivotly mounted on a support member 108 at approximately the center of mass of the pawl arm. In this embodiment of the invention, the pawl 110 is formed by an integral flap portion of the pawl arm bent approximately 30° from the pawl arm to engage the ratchet wheel catch surfaces 92. The pawl arm pivots on support member 108 to allow the pawl 110 to ride up the ratchet ramp surfaces 90 when the door is being closed and the ratchet wheel is rotating in the counterclockwise direction. As is shown in FIG. 6, after the door is closed the detent spring and roller unload the pawl and ratchet catch surface by maintaining a counterclockwise rotational force on the shaft 44. This unloading of the pawl is especially important in reducing the frictional forces which must be overcome to magnetically retract the pawl arm, as will be described hereinafter.

Tension spring 112, connecting support member 108 and the pawl arm above the pivot point, provides just enough tension to normally maintain the pawl in position for engagement with a ratchet catch surface to prevent clockwise rotation of the ratchet wheel. As may be seen in FIGS. 5 and 6, attempts to force such clockwise rotation by attempting to push the door open merely moves the pawl arm towards the side of the housing which acts as a stop, thereby rendering such forced entry impossible.

Figure 4:
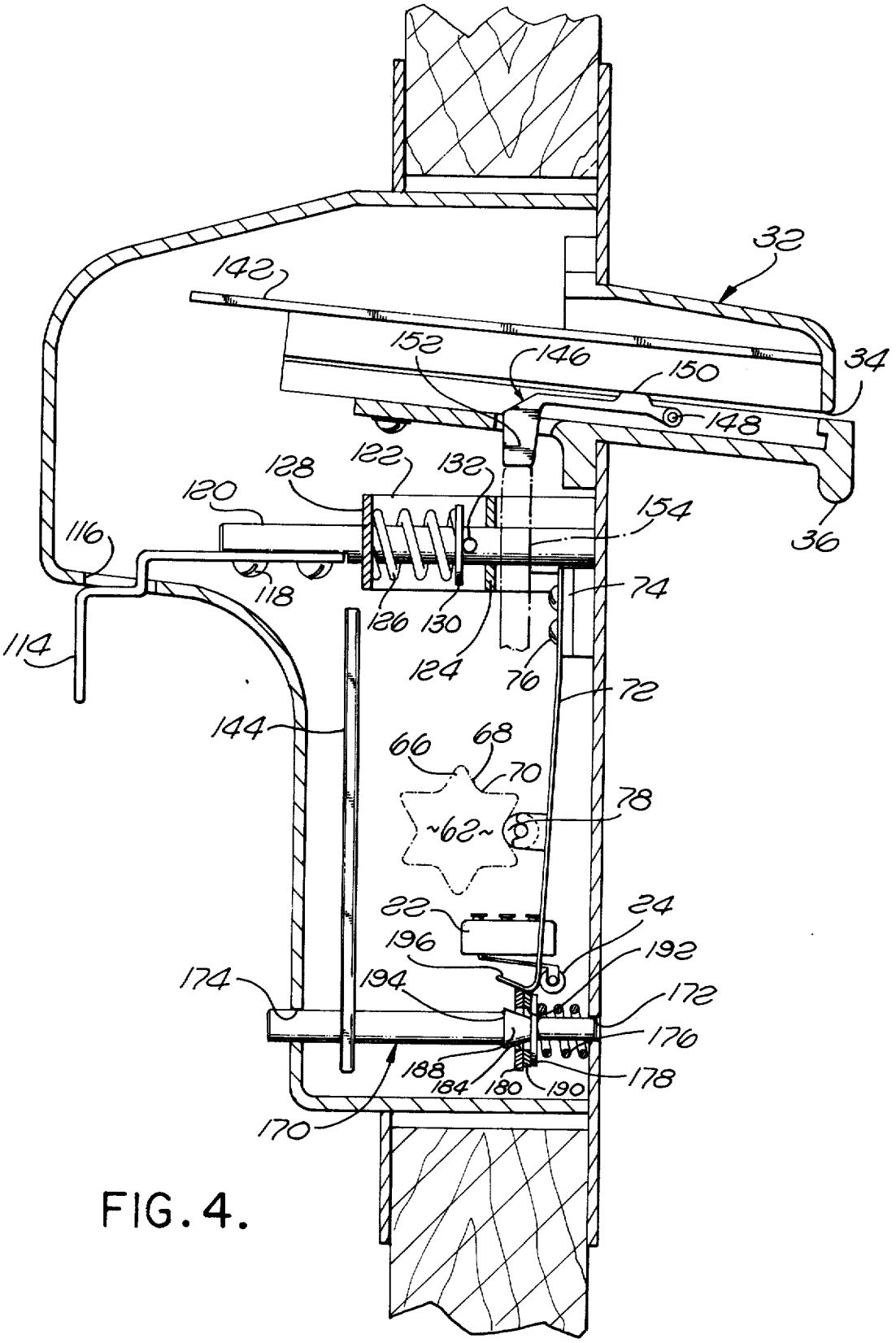
FIG. 4 is a cross-sectional elevational side view taken along the line 4—4 of FIG. 3.

In order to open the door from the inside, the room occupant grasps the handle 114 depending through housing slot 116 and pulls the handle towards the occupant into the room (FIG. 4). The handle 114 is secured by screws 118 to a reciprocatable shaft 120 which passes through central apertures (not shown) in U-shaped support members 122 and 124 secured to the wall of the housing. Compression spring 126 surrounds the shaft 120 and is retained between a connecting arm 128 of support member 122 and plate 130. Roll pin 132 passes through the shaft 120 to maintain the plate 130 in position on the shaft.

Figure 5:
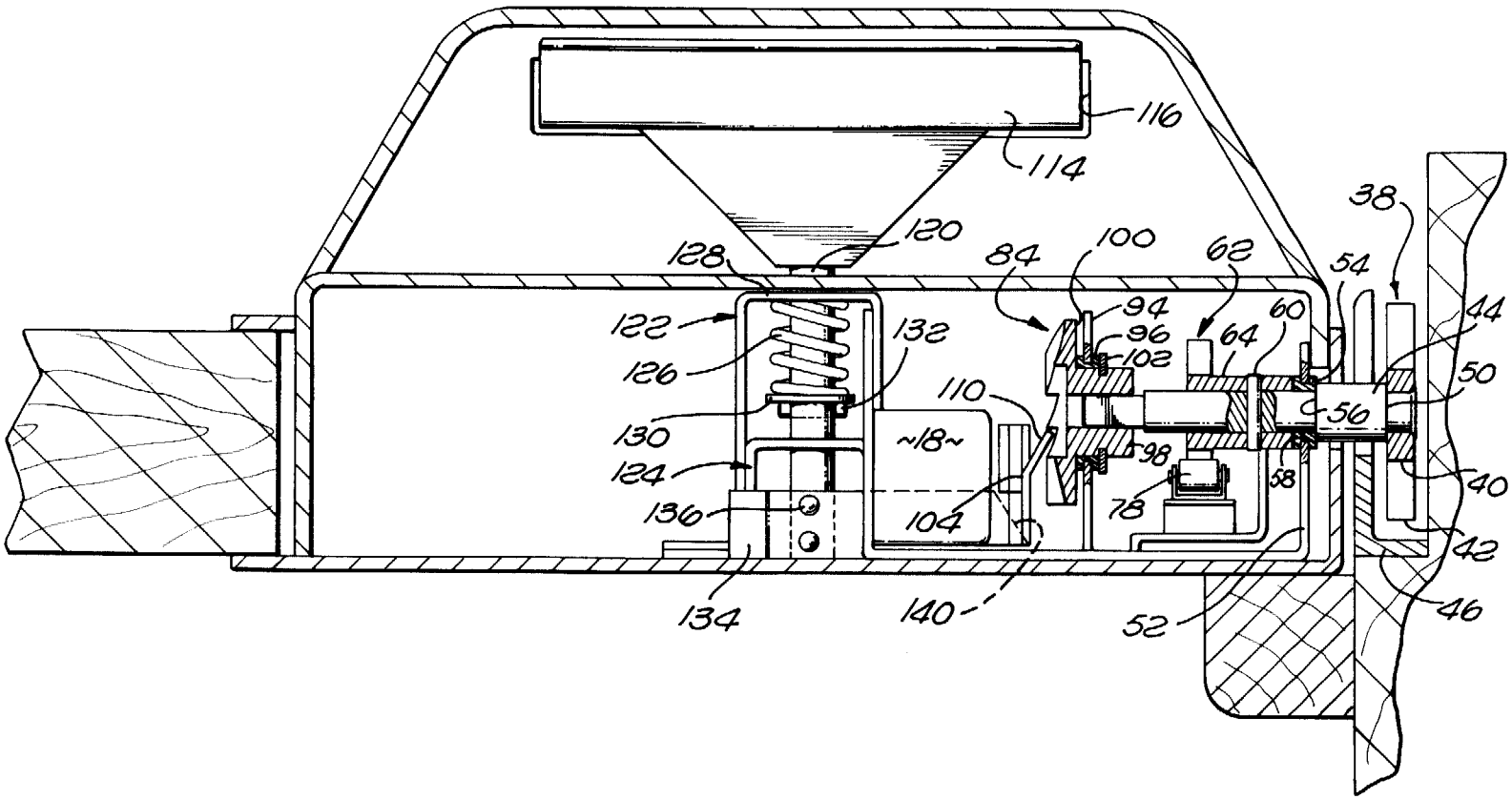
FIG. 5 is a cross-sectional plan view taken along the line 5—5 of FIG. 3.

The compression spring 126 normally maintains the shaft and handle retracted. When the handle is pulled outwardly into the room, trip plate 134, secured in a horizontal plane to the bottom of the shaft 120 by rivets 136 or the like, travels with the shaft so that the trip plate cam surface 140 engages the top of the pawl arm 104 to rotate the pawl arm about the support member 108 until the pawl 110 is retracted from engagement with the ratchet wheel (FIGS. 5–7). When the pawl is retracted, the rotatable shaft 44 and the latch wheel 38 are released for rotation and the door may be opened by further pulling on the handle 114. In addition to retracting the pawl, the trip plate 134 bears against the lower edges of the legs of the U-shaped support members 122 and 124 to prevent rotation of the handle 114.

Figure 3:
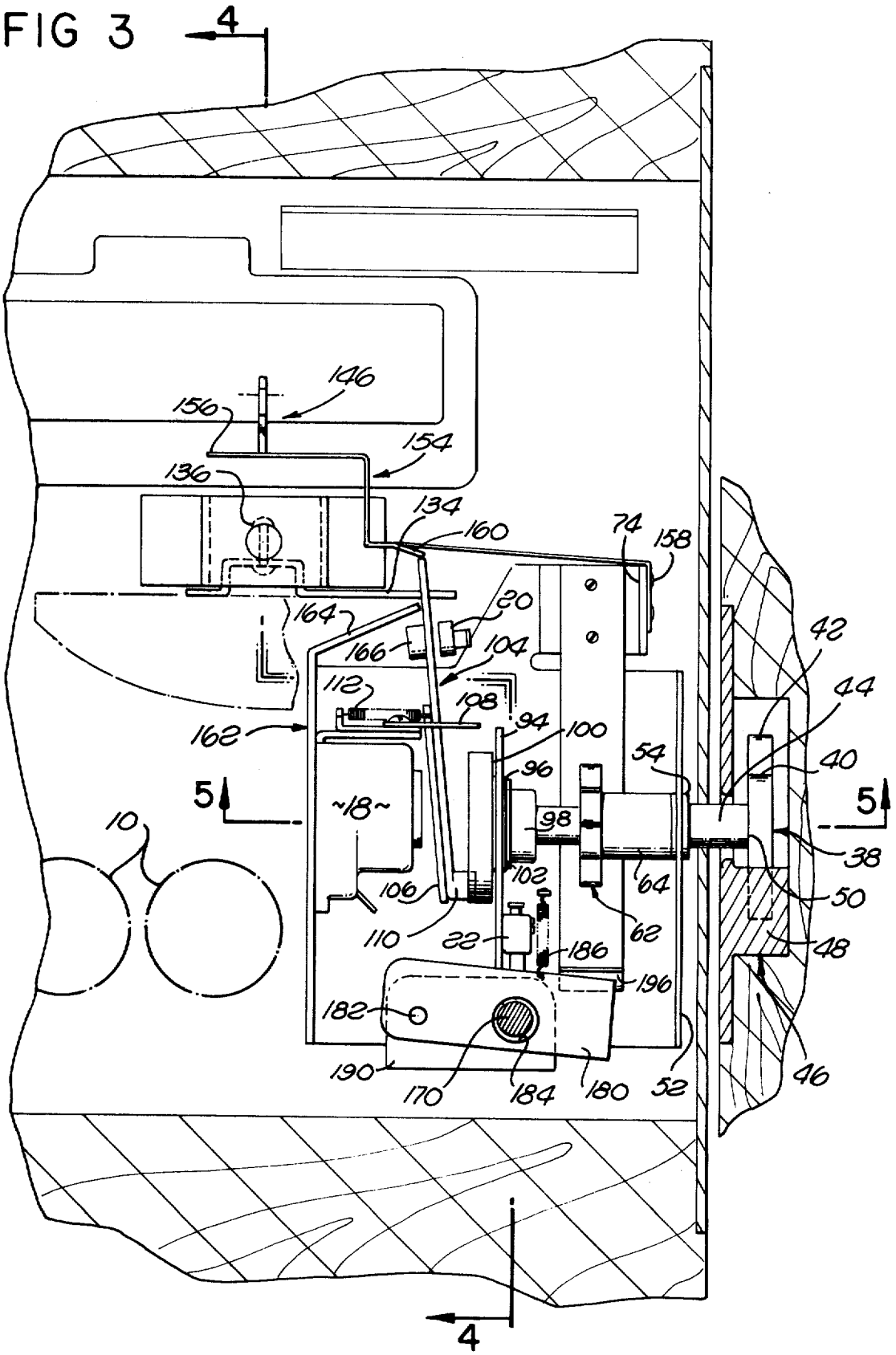
FIG. 3 is a cross-sectional elevational view taken along the line 3—3 of FIG. 2.

In this embodiment of the invention, the batteries 10 are mounted in the housing, as is shown in FIG. 3, and are electrically connected to the reader circuitry carried on a circuit board 142, shown in FIG. 4. As has been previously explained, the reader is electrically connected to the control logic circuitry, including an internal memory, carried on the circuit board 144. The means by which the circuit board is mounted in the housing have been omitted for clarity. The control logic is electrically connected to the magnetic retracted switch 20, to the lockout microswitch 22, and to the solenoid 18 by means not shown.

Upon insertion of a data combination card 14 into the card reader slot 34, the card rotates the rocker arm 146 about its pivot mounting 148 in the card reader by bearing against a rocker arm protrusion 150 extending into the card reader slot 34. The protrusion 150 is positioned midway in the reader slot so that the rocker arm will be depressed before a data combination card fully enters the slot. A depending tip 152 of the rocker arm bears against a free end 156 of the S-shaped restraining spring 154. The restraining spring, composed of an elongated piece of spring metal, is secured to L-shaped support member 74 by rivets or screws or the like (FIG. 3). When the spring 154 is depressed by rocker arm 146, lug 160 bent downwardly from spring 154 bears against the top of the pawl arm 104.

A stop is formed by an inwardly bent upper portion 164 of a support member 162 to prevent the pawl arm 104 from rotating further than is necessary for the pawl to engage the ratchet under the influence of spring 112. In this manner, the lower end of the pawl arm is maintained at a predetermined distance from solenoid 18 which is sufficiently close for the solenoid to retract the pawl when the solenoid is activated.

When a correctly coded combination card is detected in the card reader, the control logic actuates the solenoid to attract the lower end of the pawl arm and disengage the pawl 110 from the ratchet wheel 84. At the same time, the upper end of the pawl arm slips over the lug 160 which drops behind the pawl arm so that as long as a correctly coded card is in the card reader to depress the rocker arm 146 the lug will stop the pawl arm from rotating to reengage the pawl and ratchet when the solenoid is switched off. With the pawl retracted, the shaft 44 and the latch wheel 38 are free to rotate in either direction and the door may be opened by merely pushing against the door. When the pawl is in such a retracted position, the magnet 166 mounted on the upper end of the pawl arm is positioned adjacent to the magnetic switch 20. The magnetic switch is thus activated to indicate to the control logic that the pawl has been retracted and the control logic switches off the solenoid.

The lockout pin 170 extends through the housing 30 and actuates lockout switch 22 in order to disable operation of the lock in certain instances. In this embodiment of the invention where the lock is used in hotels, actuation of the microswitch 22 provides a signal to the control logic which prevents actuation of the solenoid upon insertion of data combination cards carried by service personnel employed by the hotel, even where such data combination cards are otherwise appropriately coded.

As is shown in FIGS. 3, 4, 6 and 7, the lockout switch 22 is operated from inside the room by pushing the lockout pin towards the outside of the door. More specifically, pin 170 is carried in aperture 174 in the inside face of the housing and in aperture 172 in the outer face of the housing. Compression spring 176 surrounding the pin between the exterior wall of the housing and a first annular integral pin flange 178 biases the pin to its unactivated position where the pin extends beyond the inner wall of the housing and is substantially flush with the outer wall of the housing. Latch plate 180, pivotly mounted on shaft 182 borne by bracket 190, provides an enlarged circular aperture 184 through which the pin 170 passes. The latch plate 180 is biased by spring 186 to an upwardly rotated position (FIG. 6). As the pin 170 is pushed outwardly from its unactivated position, the annular lockout pin cam surface 188 passes through the latch plate aperture 184 to rotate the latch plate downwardly. As the cam surface 188 passes beyond the latch plate, the plate is rotated upwardly by spring 186 so that the lower portion of the pin shoulder 194 bears against the latch plate 180 adjacent a latch plate aperture 184 to prevent the pin from retracting inwardly. Concurrently with the pin being extended to its outermost or activated position, the annular pin flange 178 pushes upwardly on the roller 24 of microswitch 22 positioned above the pin to activate the lockout switch. The portion of the pin protruding outside the door, which may be painted a distinctive color, indicates to the service personnel that they are unable to operate the lock.

In order to prevent unintentional deactivation of the lock which might prevent the room occupant from reentering, such as where the lockout pin is activated when the door is open, the lockout pin and switch are automatically deactivated whenever the detent roller 78 rests in a bottom land 70 of the detent wheel (FIG. 7). This is accomplished by the lower extension of the detent spring 72 which terminates in an upwardly turned cam end 196. This cam end 196 bears down upon the upper edge of the latch plate 180 whenever the detent wheel 62 is rotated so that the roller 78 moves into a detent wheel land 70 allowing the detent spring to move towards the latch plate, as previously described. The pressure of the cam end on the latch plate is sufficient to rotate the latch plate downwardly until the pin shoulder 194 no longer bears against the latch plate and the lockout pin thus retracts inwardly to the unactuated position under the force of compression spring 176. These motions are indicated by the direction arrows shown in FIG. 7 which indicate motion when a door is being opened.

In the second embodiment of this invention, shown in FIGS. 8–18, the entire electrically operated lock is contained in a housing and installed in the door of a room or the like. Electrical system for this lock is shown schematically in FIG. 8. Batteries 210 provide a source of power for the electrical system. The sensors 214 in a reader housing 260 are electrically connected with the batteries 210 by the central processing unit 212 to sense the code on a coded data combination card when one of reader sequence switches 216 mounted in the reader housing 260 is actuated by a card inserted into reader through slot 232. When the central processing unit 212 receives signals from the sensors 214 representing an authorized combination, the central processing unit operates motor 218 to actuate the mechanical portion of the lock. A retracted switch 220 is electrically connected to the central processing unit 212 to enable the central processing unit to deactivate the motor 218 when a pawl 436 has been retracted from a ratchet wheel 350 by the motor operation, as will be explained hereinafter. In addition, a lockout switch 222 when activated provides a signal to the central processing unit to prohibit connection of power to the motor when certain types of data combination cards are employed so that such cards will not operate the door even if the cards are correctly coded, as will be explained hereinafter. The two sequence switches 216 are serially actuated by insertion of a card into a card reader housing. When the first sequence switch is actuated, the central processing unit 212 energizes the sensors 214 and then waits for about three seconds, at the end of which time the central processing unit will shut off unless the second sequence switch has been activated. If the second sequence switch is activated within the first 3 second period, the sensors 214 will again be energized and the necessary central processing unit computations will be completed. The motor 213 is connected to the batteries whenever the central processing unit receives signals from the sensors indicating that a correctly coded card has been inserted into the reader housing. The motor is disconnected from the batteries 210 by the central processing unit 212 whenever the retracted switch 220 indicates that the motor 218 has unlocked the door.

Each operation of the sensors requires about 40 milliamperes for a few milliseconds. Each operation of the motor requires only about 100 milliamperes for about 1 second. Each operation of the remainder of the electrical system requires only about 14–45 microamperes for a few milliseconds. Thus, this lock system has very low power requirements which enable the batteries 210 to last for about 2 years under normal operating conditions.

Figure 2:
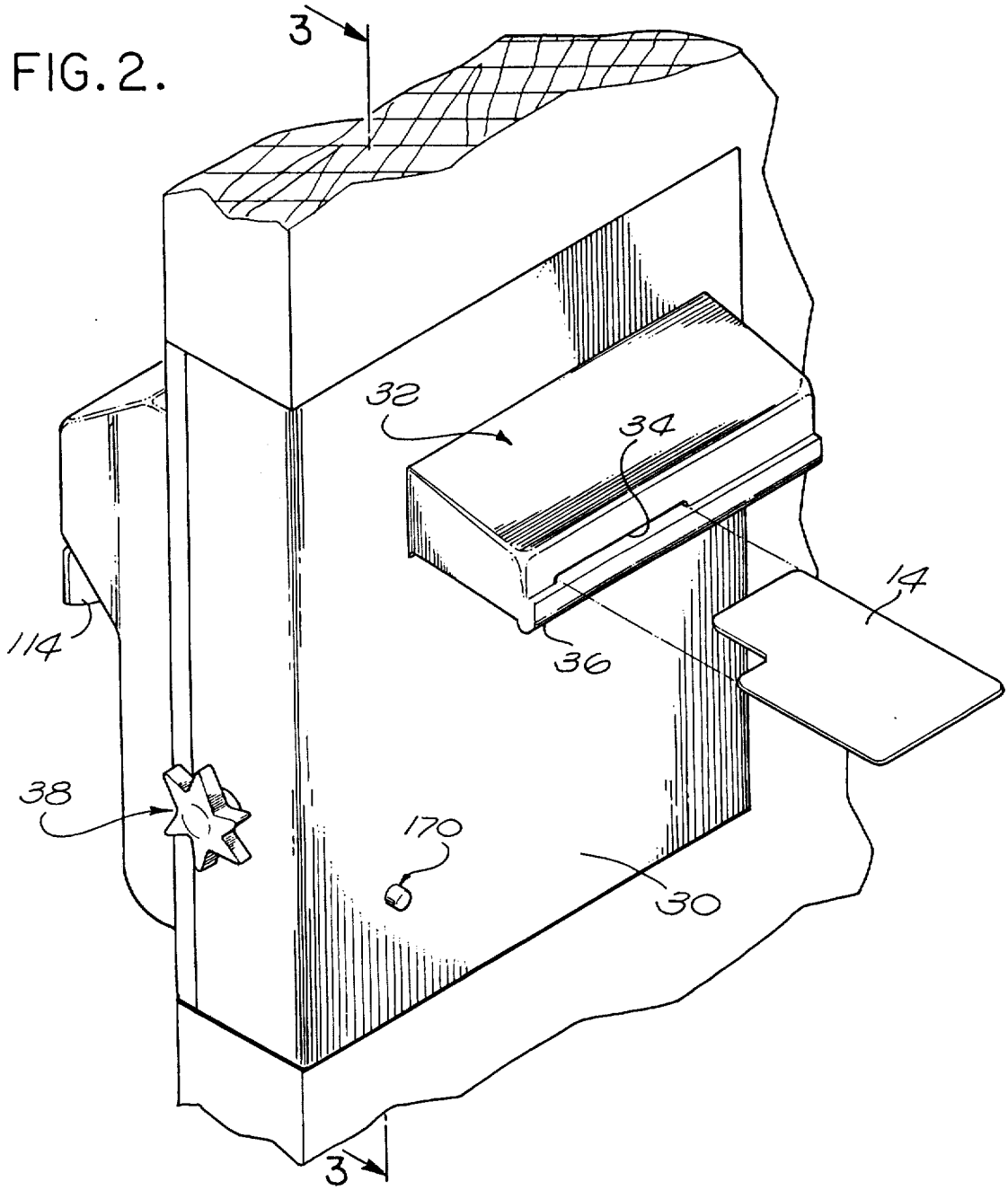
FIG. 2 is a perspective view of the lock of the first embodiment of this invention installed in a door.

The exterior appearance of the installed housing and lock of this second embodiment is substantially similar to the housing and lock exterior shown in FIG. 2. The housing may be molded or cast of a sturdy material, such as aluminum, brass, engineering plastic or the like which will withstand weathering and also resist attempts to break through the housing from the outside. In this embodiment of the invention, various metal plates and an interior cover 276, composed of engineering plastic, are secured together on the outside and the inside of the door to form the complete housing. All items necessary for operation of the second embodiment of this invention, except for the data combination card carried by the room occupant, are contained within the housing, including the necessary battery power supply, thus rendering each unit fully independent and self-contained.

Figure 9:
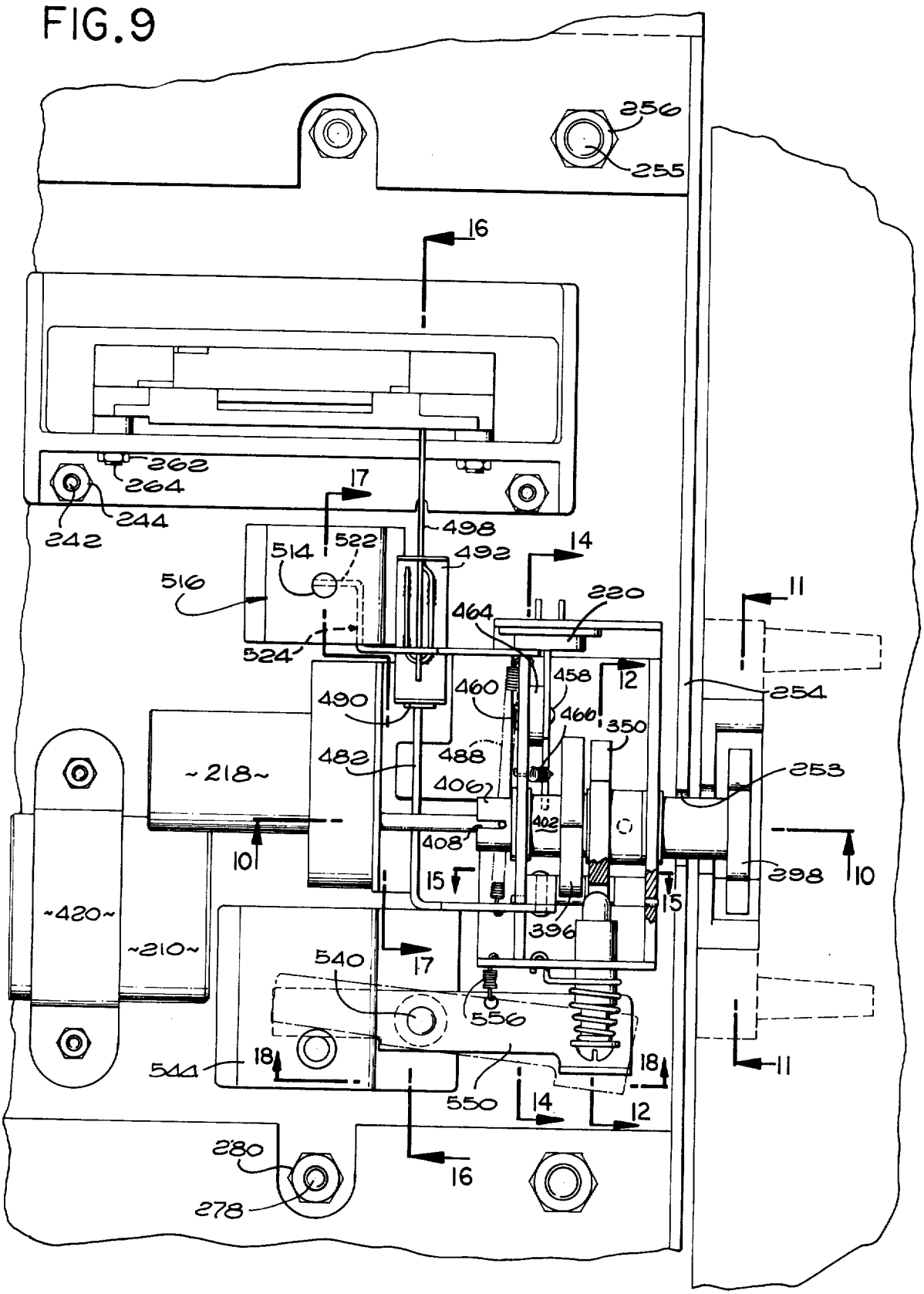
FIG. 9 is a cross-sectional elevational view of the lock of the second embodiment of this invention taken along a line similar to the line 3—3 of FIG. 2.
Figure 10:
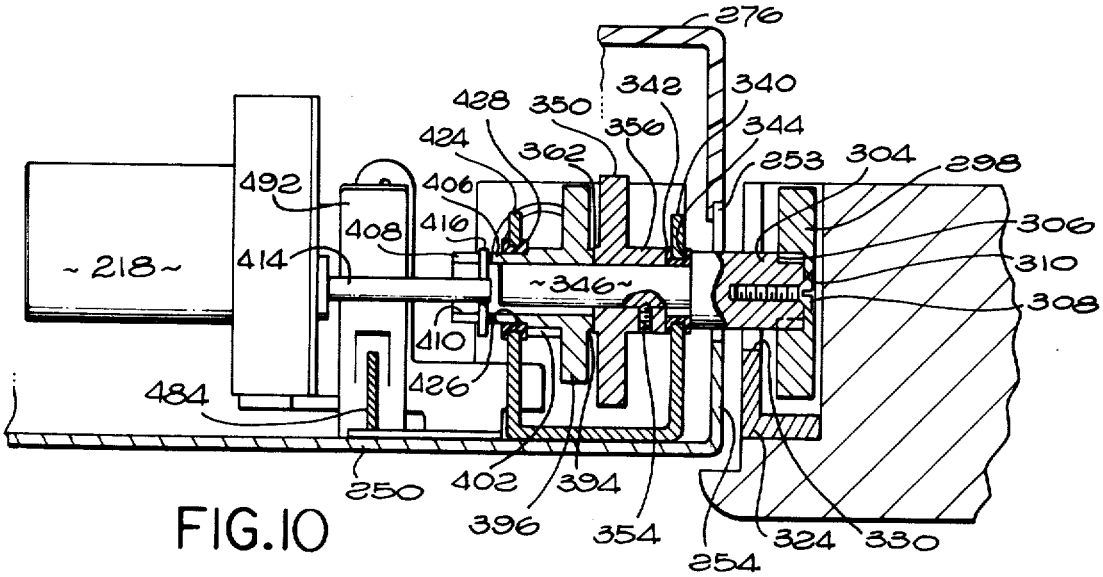
FIG. 10 is a cross-sectional plan view taken along the line 10—10 of FIG. 9.
Figure 16:
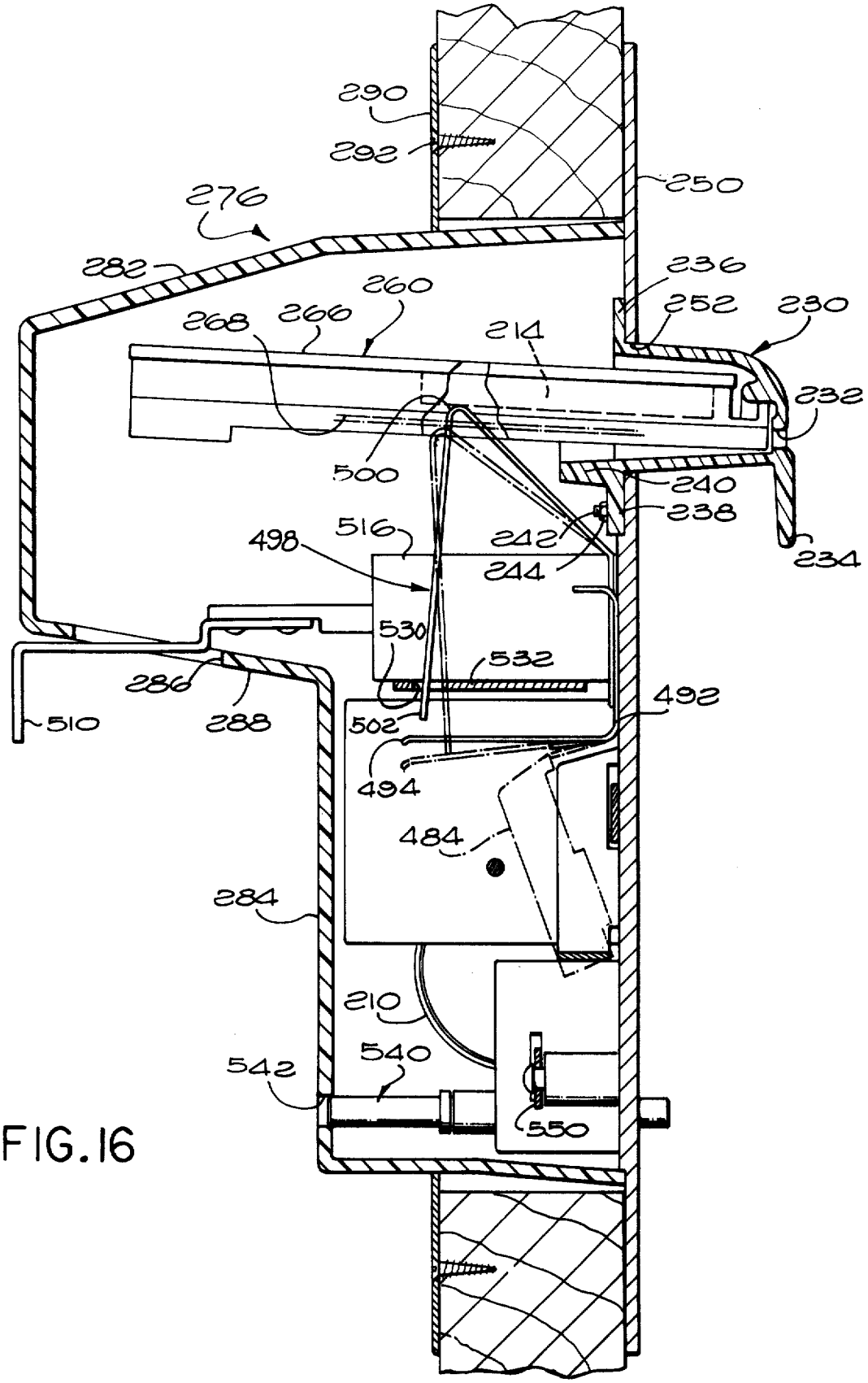
FIG. 16 is a cross-sectional elevational view taken along the line 16—16 of FIG. 9.

The housing, best seen in FIGS. 9, 10 and 16, has a protruding section 230 with a slot 232 for receiving data combination cards to be inserted from outside the door. The protruding section 230 has a depending lip 234 which provides convenient means for pushing or pulling on the door from outside once the lock is opened. The protrusion 230 has top and bottom perpendicular flanges 236 and 238 and an inwardly directed horizontal flange 240, all formed integrally with the protrusion 230. The exterior protruding section 230 is mounted in opening 252 of the exterior metal cover or face plate 250 by studs 242 passing through the lower protrusion flange 238. The studs 242 are welded to the inside of the cover plate 250. Nuts 244 are threaded onto the studs from inside the housing to secure the protrusion so that the upper and lower flanges 236 and 238 bear against the inside of the plate 250 while the flange 240 protrudes into the lock housing to mount the card reader housing 260. Thus, there is no mechanical linkage into the lock from outside the door and the door may be opened from the outside only by inserting a correctly coded data combination card into the slot 232, pausing momentarily while the necessary electronic functions are performed and the latch wheel is freed for rotation, and then pushing on the protrusion 230 to open the door.

The housing dimensions may be altered to fit practically any existing door and jamb system. Installation only requires cutting an appropriate size notch inwardly from the side or edge of the door, inserting the necessary components into the notch, and securing the plates of the housing to the door by screws or the like. The entire system may be assembled or repaired at a remote location and tested before shipment so that installation is accomplished in a matter of minutes. Since each unit is independent and contains its own energy source, connection to a high energy source or to a central control system is not required. In addition, the construction of this invention provides a lock system which is very reliable and relatively inexpensive to construct, maintain and operate.

The housing consists generally of an exterior cover plate 250 having studs previously secured to the inside of the plate, and the exterior protrusion section 230 previously described. The inside of the housing consists of the plastic cover 276 and a metal trim plate 290. The face plate 250 is mounted on the door by four studs 255 passing through holes in the door. Nuts 256, two of which are shown in FIG. 9, are threaded onto the studs 255 to secure the face plate to the door.

The card reader housing 260 is mounted inside the door cavity with the open end of the card reader housing positioned within the open end of the protrusion section to receive cards inserted from outside of the housing. When the card reader housing 260 is thus mounted within the protrusion section 230, the slot 232 in the protrusion section 230 and a slot 268 in the card reader 260 for receiving cards are aligned. The card reader housing 260 is secured to the protrusion 230 by nuts 262 threaded onto screws 264 depending from the reader housing and passing through the horizontal protrusion flange 240, as is shown in FIG. 9. The sensors 214 are mounted on a printed circuit board 266, which forms the top of the reader housing 260, and are positioned to depend into the forward portion of the housing above the reader housing slot 268. Two reader sequence switches 216, shown only in FIG. 8, are mounted in the reader housing 260 to be serially actuated by insertion of a card into the reader housing.

The interior cover 276 is secured to the exterior face plate 250 by two studs 278 passing through the cover 276 and secured by two nuts 280 to the studs 278 on the interior of the face plate 250. The cover has a top section 282 protruding outwardly into the room, adapted to provide space for the inwardly extending reader housing 260, and a lower section 284 which conceals the majority of the mechanical elements of this embodiment of the invention. A slot 286 in a substantially horizontal wall 288 between the upper and lower portions of the interior cover provides space for the handle 510 to extend into the room for operation by an occupant. A U-shaped trim plate 290 is secured to the door with four wood screws 292 to cover the four studs of the exterior face plate and surround the cover 276 on all sides except the side adjacent the door jamb. As will now be apparent, the thickness of the door is immaterial since the trim plate 290 snugly surrounds the interior cover 276 on three sides and conceals the studs 255 mounting the face plate 250. Thus, the four screws 292 on the interior of the door provide the only means of direct access to the interior of the lock housing.

Figure 11:
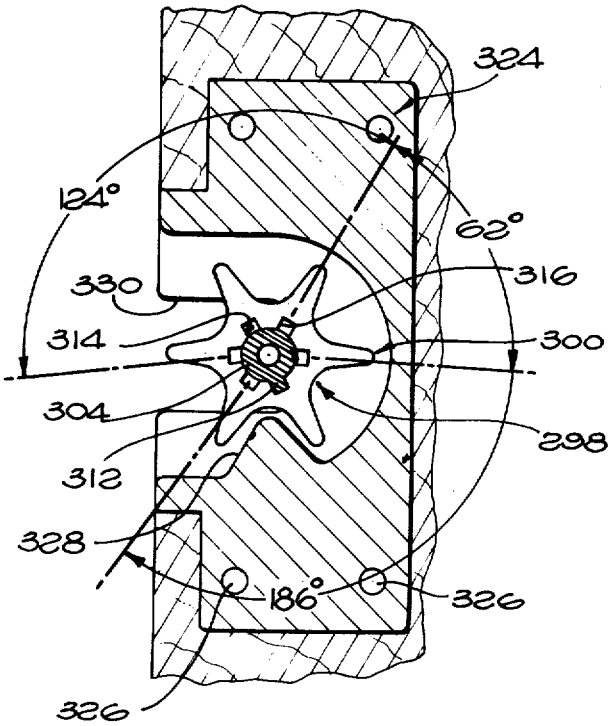
FIG. 11 is a cross-sectional elevational view taken along the line 11—11 of FIG. 9.

A rotary bolt or latch wheel 298, shown in FIGS. 9–11, having six equally spaced engaging lugs 300 and bottom lands 302, is secured to the outer end of a rotatable latch shaft 304 which extends beyond the edge of the door through slot 253 in the face plate edge flange 254 to engage a keeper 324. The latch wheel, latch shaft and keeper are composed of hardened steel or the like. The latch wheel 298 is retained on the shaft against an annular shaft shoulder 306 by means of a screw 308 engaging the shoulder of the countersunk aperture 310 in the center of the latch wheel 298 and threaded into the center of the latch shaft 304. The shaft has a key lug 312 on its outer end which fits into any one of six latch wheel notches 314 countersunk into the inside face of the latch wheel. Various of the key notches 314 are slightly angularly offset from alignment with adjacent latch wheel lugs 300 so that the key lug 312 may be shifted from one key notch to another to offset the latch wheel in relationship to the locked position of the latch shaft 304, thereby altering the relationship of the latch wheel lugs 300 with the keeper lug 328. In this manner, the latch wheel may be set in various positions on the shaft to provide a tight fit of the latch wheel in the keeper 324 when the door is closed. As is shown in FIG. 11, the central axes of two key notches are about 62° from the axis of the first aligned key notch 316, the central axes of two other key notches are about 124° from the axis of the first key notch 316, and the central axis of the key notch opposite the first notch 316 is about 186° in a clockwise direction from the axis of the first key notch 316.

The keeper 324 is secured to the door jamb by screws passing through holes 326 and has one protruding lug 328 which extends into the keeper in a direction perpendicular to the line of travel of the door as the door opens and closes. When the door is in the process of being closed, the shaft 304 is positioned in keeper slot 330 and one of the latch wheel lugs 300 engages the keeper lug 328 thereby forcing the latch wheel 298 to rotate until the keeper lug 328 fits snugly between two adjacent latch wheel lugs 300.

As is shown in FIGS. 9 and 10, the latch shaft 304 is mounted within the lock housing by support member arm 340 secured to the face plate 250 by screws, welding or the like (not shown). A plastic or nylon bearing ring or sleeve 342 surrounds the latch shaft and bears against the latch shaft shoulder 344. The bearing sleeve 342 rides against shoulder 344 on the reduced diameter interior extension 346 of the latch shaft 304. The interior shaft 346 has a D-shaped cross-section to be received by the D-shaped aperture 352 passing through the center of a ratchet wheel sleeve 356 and the ratchet wheel 350. A set screw 354 extends through ratchet sleeve 356 to engage the flat side of the D-shaft 346 to maintain the ratchet sleeve 356 against the nylon bearing 342, thereby preventing lateral movement of both the ratchet wheel 350 and the latch shaft 304.

The ratchet wheel, composed of hardened steel or the like, is similar to the latch wheel, having six equally spaced lugs or teeth 356, each tooth providing two sides 358, and adjacent teeth providing a bottom land 360 between them. The ratchet wheel is positioned on the interior shaft 346 in relation to the latch wheel key lug 312 so that one of the ratchet wheel lugs will be aligned with the axis of the latch wheel notch 316. when the key lug is positioned in the notch 316.

Figure 12:
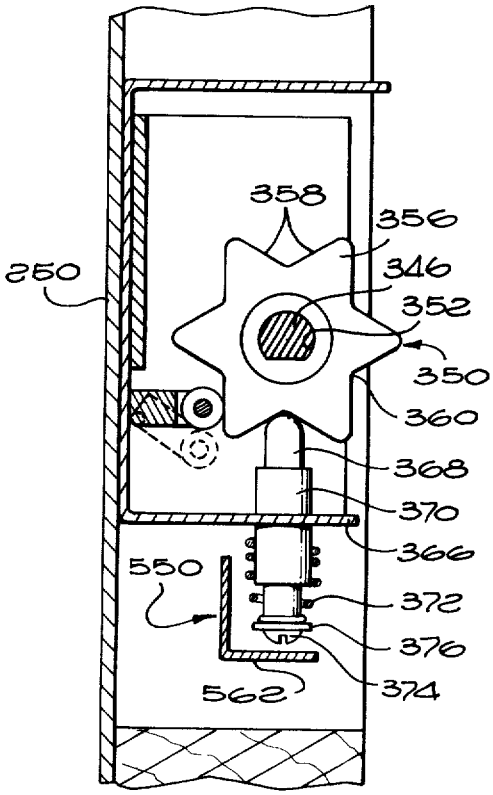
FIG. 12 is a cross-sectional elevational view taken along the line 12—12 of FIG. 9.

A horizontal support member arm 366, secured to the face plate 250 by screws or the like (not shown), supports a vertical detent pin assembly so that the upper end of a detent pin 368 engages the ratchet wheel as is shown in FIGS. 9 and 12. An alignment bushing 370 secured in the support arm 366 surrounds most of the detent pin 368 to maintain vertical alignment of the pin as the detent pin is reciprocated inside the bushing 370 by rotation of the ratchet wheel 350. A tension spring 372 is secured at its upper end to the support arm 366 and at the lower end of the spring surrounds the lower extremity of the detent pin to maintain the detent pin 368 in contact with the ratchet wheel 350. A screw 374 threaded into the bottom of the pin 368 and a washer 376 hold the spring aginst the lower end of the pin 368. The pin is maintained against the ratchet wheel with sufficient force so that when the door is opened, the detent pin will force the ratchet wheel 350 to rotate until the pin 368 engages in one of the ratchet wheel lands 360. In this manner, the ratchet wheel will normally be rotated with a lug 30° from the vertical to position the latch wheel lugs 300 for correct engagement with the keeper lug 328.

As the lower most latch wheel lug 300 comes into contact with the keeper lug 328 when the door is being closed, the latch wheel will rotate clockwise about 60° as viewed in FIG. 11. At the same time the ratchet wheel 350 will also rotate about 60° so that the detent pin 368 is depressed by riding up on a ratchet wheel tooth 356 to come to rest on the opposite inclined side 358 of that ratchet wheel tooth. In this position, the detent pin applies the biasing force to the ratchet wheel which attempts to continue the closing rotation of the ratchet wheel, latch shaft, and latch wheel, thus holding the door firmly shut.

An alternative embodiment of the ratchet wheel is shown in FIG. 13 where a modified ratchet wheel 380 is adapted for use with a similarly constructed latch wheel (not shown) having only three lugs 382. A restraining pin 384 rides in a ratchet wheel slot 388 extending about 60° around the ratchet wheel. The restraining pin 384 is rigidly carried by an arm 386 secured to the housing. When the door is opened and the latch wheel rotates, the ratchet wheel will also rotate about 60° so that the restraining pin 384 is in the upper end of the slot 388. When the door is closed again, the ratchet wheel will rotate in the opposite direction to the position shown in FIG. 13. Thus, the latch wheel will be restrained from rotating more than 60° and need only have two lugs 300 to engage opposite sides of the keeper lug 328.

A cam assembly, shown in FIGS. 9, 10 and 14, includes a slightly protruding annular bearing surface 394 adapted to ride against the slightly protruding annular bearing surface 362 of the ratchet wheel 350, a large ratchet cam 396, a small switch cam 402, and a slotted sleeve 406.

The interior D-shaft 346 of the latch shaft 304 extends into the circular cam assembly bore 410 but terminates short of the open ended slots or notches 408 in the sides of the cam sleeve 406. A cylindrical motor shaft 414 carrying a transverse roll pin 416 extends into the cam bore 410 through the cam sleeve 406. The roll pin 416 engages the cam sleeve slots 408 to drive the cam assembly with the motor shaft 414. The motor shaft 414 is driven by a one-way drive motor 418 which, in this embodiment of the invention, is a 20 RPM, 6 volt, 100 milliampere motor. The motor 418 is supplied power by magnesium alkaline batteries 210 mounted in the housing by bracket 420. The batteries provide 6 volts for 1 ampere-hour and have a shelf life of 5 years. When activated, the motor rotates the shaft counterclockwise in FIG. 14. The cam assembly sleeve 406 passes through a hole 426 on a support bracket arm 424 so that the support bracket bears against the shoulder of the switch cam 402. A nylon bearing 428 provides the bearing surface between the switch cam 402, the cam sleeve 406, and the support bracket arm 424.

It will be apparent that the cam assembly is not actuated by rotation of either the latch wheel or the ratchet wheel, although the cam assembly is partially supported loosely on the end of the latch wheel shaft 304. Thus, the latch wheel 298, ratchet wheel 350, or both may be disabled or pried, by force or otherwise, without opening the door through the cam assembly.

In this embodiment of the invention, the only means of activating the motor 418, and thus the cam assembly, is by insertion of a correctly coded card through the protrusion slot 232 fully into the card reader slot 268. When this is accomplished, the central processing unit 212 activates the motor to rotate the cam assembly counter-clockwise in FIG. 14 for about one second. The cam assembly is rotated by the motor approximately 260°, at which point the motor is shut off by the retracted switch 220. As will be explained hereinafter, activation of the retracted switch indicates that the ratchet wheel is able to be rotated and that the door is therefore unlocked. However, the inertia of the cam assembly causes the motor to coast to a stop to a position where the cam assembly has rotated about a full 360°.

Figure 15:
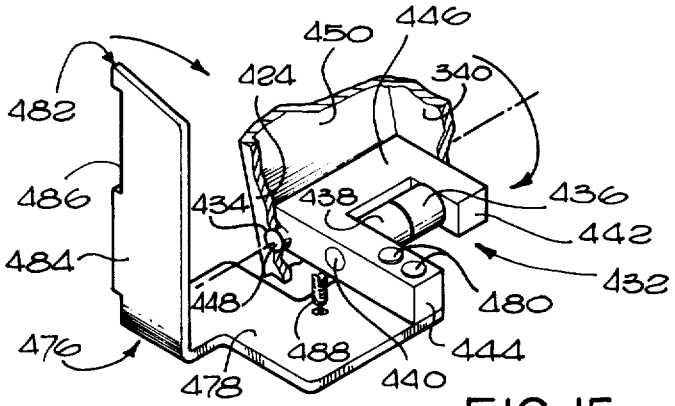
FIG. 15 is a perspective view taken generally along the line 15—15 of FIG. 9.

The support members 340 and 424 provide aligned apertures 434 for pivotal mounting of a U-shaped catch plate 432, shown in FIGS. 9, 12, 14 and 15, having a pawl or ratchet roller 436 and a cam roller 438 loosely pivoted on a roll pin 440 passing through the short leg 442 and the long leg 444 of the catch plate. The catch plate is pivoted about pivot pin 448 through the lower corner of the cross-member 446 adjacent the support cross-member 450 so that rearward edge 452 of the catch plate bears against the support 450. The catch plate 432 is thus only permitted to rotate downwardly from its normal position, as indicated in FIG. 15, so that the ratchet and latch wheels are able to rotate counter-clockwise (in FIG. 14) freely when the door is being closed but cannot rotate clockwise when the door is attempted to be opened by means other than a correctly coded card or from the inside.

The cam roller 438 rides on the exterior cam surface of the ratchet cam 396 so that the catch plate 432 is rotated downwardly or clockwise in FIGS. 14 and 15 as the cam roller rides up on the ratchet cam rise 398. At the same time, the pawl or ratchet roller 436, which has previously been engaged against the side 358 of a ratchet wheel lug 356, rotates downwardly with the catch plate and out of the way of the ratchet wheel lugs 356 to allow the ratchet and latch wheels 350 and 298 to rotate freely, as is shown in FIG. 12. The catch plate rotates sufficiently for the ratchet roller to disengage the ratchet wheel about 90° before the cam roller arrives at the cam rise 398. The catch plate is held in this depressed condition so that the ratchet wheel is free to rotate as long as a correctly coded card is inserted into the card reader, as will be explained hereinafter.

A switch actuator plate 456, shown in FIGS. 9 and 14, is rotatably secured to the support member arm 424, in a plane parallel to the support member arm, by a bolt 458 or the like passing through a hole in the switch actuator plate and through the support member arm to be secured on the other side of the support arm by a nut 460. A small diameter spacer bushing 462 within the hole in the actuator plate receives the bolt 458 and maintains the actuator plate loosely spaced between the bolt head and the outwardly extending spacer flange 464. A spring 466 secured to the support bracket arm 424 and to a depending actuator plate leg 468 maintains the actuator plate contact lug 470 rotated into contact with the retracted pressure switch 220 mounted above the contact lug. The lower corner 472 of the actuator plate is contacted by the cam rise 404 of the switch cam 402 as the cam assembly is rotated by the motor 218. As the switch cam rise 404 hits the actuator plate lower corner 472, the actuator plate rotates clockwise in FIG. 14 so that the contact lug 470 is removed from contact with the retracted switch 220. This signals the central processing unit 212 to shut off the motor 418. The orientation of the switch cam 402 and the ratchet cam 396 are such that the motor is shut off when the cam roller 438 has just passed the ratchet cam rise 398, as is shown in FIG. 14(C).

An L-shaped catch arm 476, shown in FIGS. 9, 10 and 15–17, has a horizontal plate 478 secured to the catch plate long leg 444 by rivets 480 or the like so that the catch plate 432 and the catch arm 476 are rotated clockwise in FIG. 15 by the ratchet cam 396 on the cam roller 438. The tapered end 482 of an upstanding leg 484 is adapted to engage a cut out lug 490 depending from an L-shaped latch 492 secured to the face plate by welding or the like. When the lock is latched, the upstanding leg 484 is positioned adjacent the face plate 250 by a spring 488 which is secured between support arm 424 and the catch arm plate 478. The catch plate 432 and catch arm 476 are thus normally rotated counterclockwise in FIGS. 15 and 17 against the face plate 250 so that the ratchet roller 436 engages the ratchet wheel 350.

A generally U-shaped spring 498, shown in FIGS. 9 15 and 16, is secured to the face plate 250 by welding or the like with the upper cam end 500 of the spring protruding into the card reader housing 260 through a notch (not shown). The free end 502 of the spring is normally disengaged from the free end 494 of the latch 492, as is shown in FIG. 16 by the solid line indication of spring 498. However, when a card is inserted into the card reader slot 268, the card engages the spring cam end 500 and pushes the free end 502 of the spring downwardly onto and against the free end 494 of the latch 492 to push the latch lug 490 downwardly from its normal position, as is shown by the dotted lines in FIG. 16. When the ratchet cam 396 rotates the catch plate 432 in FIGS. 15 and 17, the catch arm 476 is also rotated until the tapered end 482 of the catch arm 476 rotates clockwise past the depending latch lug 490. The tapered catch arm end 482 engages the latch lug 490 to hold the ratchet roller 436 out of engagement with the ratchet wheel 350 until the catch arm 476 is released by removing the card. When the card is removed, the spring 498 moves upwardly into the card reader and the latch lug 490 springs upwardly to release the catch arm 476 and the catch plate 432.

In this manner, a person entering the room with a correctly coded card may open the door any time after the card is inserted, the motor has rotated the ratchet cam 396, and while the card is in the reader. However, when the card is removed from the reader, the ratchet wheel will be reengaged by the pawl or ratchet roller so that the door will not open if it has not yet been opened and so that an opened door will be locked when it is again closed.

Figure 17:
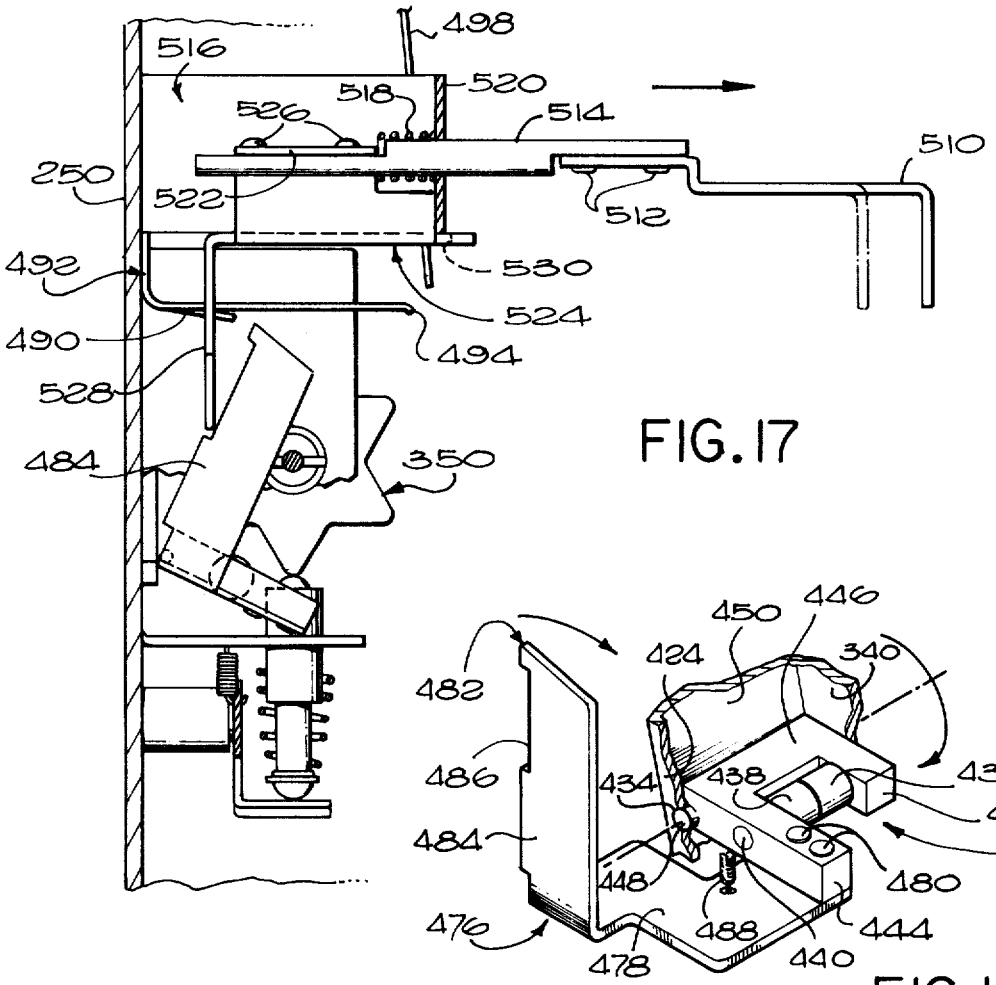
FIG. 17 is a cross-sectional elevational view taken along the line 17—17 of FIG. 9; and, FIGS. 18A and 18B are cross-sectional plan views taken along the line 18—18 of FIG. 9 and showing the actuated and unactuated positions of the lockout switch and associated elements.

In order to open the door from the inside, the room occupant grasps the handle 510 protruding into the room through the housing cover slot 286 and pulls the handle toward the occupant into the room. The handle 510 is secured by screws 512 to a reciprocatable shaft 514, as is shown in FIGS. 16–17. The shaft 514 passes through an aperture in U-shaped support member 516 secured to the housing face plate 250. A compression spring 518 surrounds the handle shaft 514 and is retained between the support member leg 520 and a horizontal flange 522 of a release arm 524. The horizontal release arm flange 522 is secured to the handle shaft by rivets 526. A vertical release arm 528 is adapted to engage the vertical leg 484 of the catch arm 476 in a catch arm recess 486 when the handle is pulled.

The compression spring 518 normally maintains the shaft 514 and the handle 510 retracted. When the handle 510 is pulled inwardly into the room, the depending leg 528 of the release arm or trip plate 524 contacts the upstanding leg 484 of the catch arm 476 to rotate the catch arm and the attached catch plate 432 about the pivot 448. In this manner, the pawl 436 is disengaged from the ratchet wheel whenever the handle 510 is pulled inwardly into the room. In addition, the spring 498 passes through a slot 530 in a release arm intermediate flange 532 so that the free end 502 of the spring 498 is pulled off of the end 494 of the latch 492, thus releasing the latch and the depending lug 490 to assume their upward position out of contact with the upstanding leg 484 of the catch arm 476. This insures that the catch arm 476 will not be engaged by the depending lug 490 as the catch arm is rotated by the reciprocation of the handle 510 and release arm 524. When the handle is released, the release arm returns to its original position under the influence of the compression spring 518 and the upstanding leg 484 of the catch arm 476 passes under the lug 490 to its latched position against the face plate.

Figure 18:
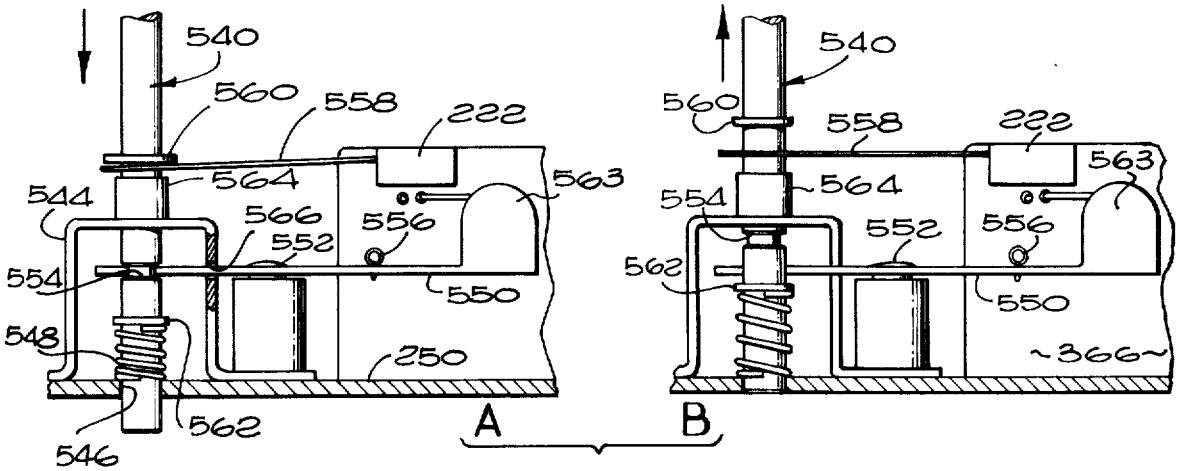

A lock-out pin 540, shown in FIGS. 9, 16 and 18, extends through the housing and actuates a lock-out switch 222 in order to disable electrical operation of the lock in certain instances. The lock-out switch 222, such as a microswitch, is operated from inside the room by pushing the lock-out pin 540 towards the outside of the door. More specifically, the pin 540 is carried in an aperture 542 in the inside cover 276, in an aperture in the cross leg of a U-shaped support member 544 secured to the face plate, and in an aperture 546 in the exterior face plate 250. A compression spring 548, held between the face plate 250 and the pin flange 562, normally biases the lock-out pin towards the interior of the room (FIG. 18B). A lever 550 pivoted on a pin 552 extends through slot 566 in the support member to engage the recessed area 554 in the pin whenever the pin is pushed outwardly thereby stopping the pin from moving inwardly. A tension spring 556 (FIG. 9) secured between the detent support member 366 and the lever 550 biases the lever 550 into engagement with the pin. The lock-out switch 222 mounted on the support 366 has an arm 558 extending across the pin to be contacted by a pin flange 560 whenever the pin is pushed outwardly (FIG. 18A). When the pin is pushed outwardly, the switch 222 renders the lock electrically inoperable. Bushing 564 secured to the support 544 and surrounding the pin prevents further outward travel of the pin when contacted by the pin flange 560.

The lock-out pin 540 is automatically released by the lever 550 whenever the ratchet wheel is rotated, such as when the door is opened or closed. As the ratchet wheel 350 rotates, the detent pin 368 is pushed downwardly against the horizontal flange 562 of the lock-out lever 550 to raise the lever out of engagement with the pin recess 554, thus allowing the spring 548 to push the pin inwardly. When the pin moves inwardly, the pin flange 560 no longer engages the lock-out switch arm 558 and the lock is able to be electrically operated.

While this invention has been shown and described in terms of a particular embodiment it will be understood that various modifications and changes may be made without departing from the actual scope of the invention.

What is claimed is:

1. An electric lock, said lock being operable in response to a combination applied to said lock by insertion into the lock of a card carrying the combination, comprising:

a lock housing;

a rotatable latch protruding from the lock housing and adapted to engage a keeper mounted adjacent the lock housing;

a toothed ratchet inside the lock housing adapted to rotate with the latch;

retractable pawl normally biased for engagement with said ratchet to prevent rotation of the latch in at least one direction;

means for receiving and detecting the applied combination, comparing said detected combination with stored combination information, and generating an activation signal when the comparison is favorable;

means adapted to retract said pawl from said ratchet in response to said activation signal;

means for maintaining said pawl in a retracted position as long as a card bearing a code generating a favorable comparison remains inserted into the lock;

means for terminating operation of the retracting means after the pawl is retracted; and, an energy source connected to supply the power requirements of said lock.

2. An electric lock, said lock being operable in response to a combination applied to said lock, comprising:

a lock housing;

a rotatable latch protruding from the lock housing and adapted to engage a keeper mounted adjacent the lock housing;

a toothed ratchet inside the lock housing adapted to rotate with the latch;

retractable pawl normally biased for engagement with said ratchet to prevent rotation of the latch in at least one direction;

means for receiving and detecting the applied combination, comparing said detected combination with stored combination information, and generating an activation signal when the comparison is favorable;

means adapted to retract said pawl from said ratchet in response to said activation signal;

means for maintaining said pawl in a retracted position for a sufficient period of time to allow the door to be opened after a combination generating a favorable comparison is applied;

means for terminating operation of the retracting means after the pawl is retracted; and, an energy source connected to supply the power requirements of said lock.

3. An electric lock as defined in claim 2, further comprising:

means for biasing the ratchet for movement of the opposing ratchet tooth away from the pawl and concurrently biasing the latch into the keeper when the latch is engaged in the keeper, and for positioning the latch for appropriate angular engagement with the keeper when the latch is disengaged from the keeper.

4. An independently operable electric lock, said lock being operable in response to a combination applied to the lock from a first side of the lock and also in response to movement of a handle protruding from a second side of the lock, comprising:

a lock housing adapted to be secured in a door;

a rotatable latch wheel protruding from the housing and adapted to engage a keeper mounted adjacent the lock housing;

a ratchet wheel inside the housing connected for rotation with the latch wheel;

a retractable pawl normally biased into engagement with said ratchet wheel to prevent disengagement of said latch wheel and keeper;

means for retracting said pawl from said ratchet wheel when said handle is operated;

means for receiving and detecting the applied combination, comparing said detected combination with combination information stored within the housing, and generating an activation signal when the comparison is favorable;

means within said housing adapted to retract said pawl from said ratchet wheel in response to said activation signal;

means for terminating operation of said retracting means when the pawl is retracted;

means for maintaining said pawl in a retracted position for sufficient period of time to allow the door to be opened after a combination generating a favorable comparison is applied to the lock; and, an energy source within said housing and connected to supply the power requirement of said lock.

5. An independently operable electric lock as defined in claim 1 wherein said ratchet wheel is toothed, and further comprising:

means for rotating the ratchet wheel to move an opposing ratchet tooth away fromn the pawl and concurrently rotating the latch wheel into the keeper when the latch wheel is engaged in the keeper, and for positioning the latch wheel for appropriate angular engagement with the keeper when the latch wheel is disengaged from the keeper.

6. An electric lock as defined in claim 1 wherein said combination is applied to said lock by insertion into the lock of a card carrying the combination, and wherein said means for maintaining said pawl in a retracted position comprises means for maintaining said retraction as long as a card bearing a code generating a favorable comparison remains inserted into the lock.

7. An independently operable electric lock, said lock being operable in response to insertion of a combination from a first side of the lock and in response to movement of a handle protruding from a second side of the lock, comprising:

a lock housing adapted to be secured in a door;

a rotatable shaft protruding from the housing;

a rotatable latch wheel protruding from the housing and rigidly mounted on said shaft, said latch wheel having a plurality of lugs adapted to engage a keeper mounted in a door jamb adjacent to the door;

a ratchet wheel inside the housing rigidly mounted on a shaft for rotation with the latch wheel, said ratchet wheel having ratchet teeth for engagement by a pawl;

a detent wheel inside the housing rigidly mounted on a shaft for rotation with said latch wheel, said detent wheels having a plurality of lugs and bottom lands between the lugs;

a pawl arm pivotally mounted within said housing and carrying a pawl at one end thereof, said pawl being normally biased into engagement with the teeth of said ratchet wheel to prevent disengagement of said latch wheel and keeper;

trip means adapted to be operated by the handle, said trip means being adapted to disengage the pawl from the ratchet wheel when the handle is operated;

a reader section within said housing, said reader section having means communicating with the first side of said lock housing to receive a combination;

means within said housing for detecting a received combination, comparing the received combination with combination information stored within the housing, and generating an activation signal when the comparison is favorable;

means adapted to pivotally retract the pawl from said ratchet wheel in response to said activation signal;

means for maintaining said pawl disengaged from said ratchet wheel for a sufficient period of time to allow the door to be opened after said favorable comparison;

switch means adapted to deactivate said retracting means when the pawl has been retracted from the ratchet wheel;

a direct current energy source mounted within the housing and connected to supply the power requirements of the lock; and, a detent spring mounted within the housing, said detent spring carrying at its free end means adapted to engage the lugs and bottom lands of said detent wheel.

8. An independently operable electric lock as defined in claim 7 wherein:

said latch wheel lugs are adapted to engage opposite sides of a mating lug of said keeper;

said trip means comprises a trip plate secured to said handle, said trip plate being adapted to engage said pawl arm to pivotally disengage the pawl arm from the ratchet wheel when the handle is operated;

said reader section communicating means comprising a slot communicating with the first side of said lock to receive a card bearing said combinations;

said retracting means comprising a solenoid mounted within the housing adjacent the pawl;

said means adapted to engage the lugs and bottom lands of said detent wheel comprises a detent roller; and, said latch wheel, detent wheel, and ratchet wheel being so positioned with respect to each other that when the door is closed the pawl does not contact any ratchet wheel teeth and the latch wheel is rotated as far as possible into engagement with said keeper, and one lug of the latch wheel is positioned for engagement with the lug of the keeper when the door is open.

9. An electric lock as defined in claim 7 wherein said combination is applied to said lock by insertion into the lock of a card carrying the combination, and wherein said means for maintaining said pawl disengaged comprises means for maintaining said disengagement as long as a card bearing a code generating a favorable comparison remains inserted into the lock.

10. An independently operable electric lock, said lock being operable in response to insertion of a coded card carrying an appropriate combination from a first side of the lock and in response to movement of a handle protruding from a second side of the lock, comprising:

a lock housing adapted to be secured in a door;

a rotatable shaft protruding from the housing;

a latch wheel rigidly mounted on said shaft outside said housing, said latch wheel having a plurality of latch lugs adapted to engage opposite sides of a mating keeper lug of a keeper mounted in a door jamb adjacent to the door;

a ratchet wheel rigidly mounted inside the housing on said shaft for rotation with the latch wheel, said ratchet wheel having ratchet teeth for engagement by a pawl and bottom lands between the teeth;

a pawl arm mounted within said housing for pivotal movement about a pivot axis and carrying a roller rotatable about a roller axis parallel to said pivot axis, said pawl arm being normally biased to position said roller for engagement with a face of one of the teeth of said ratchet wheel to prevent disengagement of said latch wheel and keeper, with the plane containing said axes substantially perpendicular to said face;

means coupled to said handle to engage said pawl arm to pivotally disengage the pawl roller from the ratchet wheel when the handle is operated;

a reader section within said housing, said reader section having a slot communicating with the first side of said lock to receive a coded card;

means within said housing for detecting a combination borne by a card inserted into the reader section, comparing the detected combination with combination information stored within the housing, and generating an activation signal when the comparison is favorable;

means within the housing adapted to pivotally disengage the pawl roller from said ratchet wheel in response to said activation signal, said disengaging means including a motor;

means for maintaining said pawl roller disengaged from said ratchet wheel after activation of said motor while the card remains inserted in said reader section;

switch means adapted to deactivate said motor when the pawl roller is retracted from the ratchet wheel;

a direct current energy source connected to supply the power requirements of the lock; and detent means mounted within the housing, said detent means being adapted to engage the teeth and bottom lands of said ratchet wheel;

said latch wheel and ratchet wheel being so positioned with respect to each other that there is normally no substantial force between the pawl roller and any of the ratchet teeth and the latch wheel is rotated into positive engagement with said keeper when the door is closed, and one lug of the latch wheel is positioned for engagement with the lug of the keeper when the door is open.

* * * * *